US011352807B2

(12) United States Patent
Horton et al.

(10) Patent No.: US 11,352,807 B2
(45) Date of Patent: Jun. 7, 2022

(54) URBAN HIDE SCREEN FOR SURVEILLANCE OPERATIONS IN URBAN ENVIRONMENTS

(71) Applicant: Nomadic Research LLC, Annapolis, MD (US)

(72) Inventors: Matt Horton, Annapolis, MD (US); Dagan Van Oosten, Annapolis, MD (US)

(73) Assignee: Ten22Fifty Inc., Dixon, IL (US)

( * ) Notice: Subject to any disclaimer, the term of this patent is extended or adjusted under 35 U.S.C. 154(b) by 483 days.

(21) Appl. No.: 16/173,849

(22) Filed: Oct. 29, 2018

(65) Prior Publication Data

US 2020/0131762 A1 Apr. 30, 2020

(51) Int. Cl.

| | |
|---|---|
| ***E06B 9/24*** | (2006.01) |
| ***E04H 15/00*** | (2006.01) |
| *E04B 2/74* | (2006.01) |

(52) U.S. Cl.

CPC ..... *E04H 15/005* (2013.01); *E06B 9/24* (2013.01); *E04B 2002/7479* (2013.01)

(58) Field of Classification Search

CPC ... E04H 15/005; E04H 15/003; E04H 15/001; E04H 15/006; E04H 15/34; E04H 15/36; E04H 15/40; E04H 15/405; E04H 15/42; E04H 15/425; E04H 15/44; E04B 2002/7479; E06B 9/24

See application file for complete search history.

(56) References Cited

U.S. PATENT DOCUMENTS 1,288,518 A * 12/1918 Collier ..... E04H 15/44 135/157
2,036,033 A * 3/1936 Fisher ..... E04H 15/56 135/133
2,612,900 A * 10/1952 Treppa ..... E04H 15/003 135/141
2,819,901 A * 1/1958 Mateja ..... A63B 71/022 473/421
2,855,037 A * 10/1958 Stiffel ..... E04B 2/7438 160/135
3,223,098 A * 12/1965 Dole, Jr. ..... E04H 15/425 135/126
3,394,720 A * 7/1968 Moss ..... E04H 15/003 135/125
3,593,474 A * 7/1971 Neels ..... E04B 2/7433 52/223.7
4,078,572 A * 3/1978 Moss ..... E04H 15/18 135/118
4,269,210 A * 5/1981 Marks ..... E04H 15/14 135/125
4,352,362 A * 10/1982 Nichols ..... E04H 15/40 135/98
4,632,138 A * 12/1986 Irwin ..... E04H 15/001 135/143

(Continued)

*Primary Examiner* — Johnnie A. Shablack

(74) *Attorney, Agent, or Firm* — Lowe Graham Jones PLLC

(57) ABSTRACT

Embodiments are directed to a hide screen for surveillance operations in urban environments. The hide screen may include a netting panel, a plurality of sleeves, and a plurality of frame poles. One or more of the sleeves may be coupled to the netting panel. The frame poles may be insertable into the sleeves to tension the netting panel.

13 Claims, 6 Drawing Sheets

(56) References Cited

U.S. PATENT DOCUMENTS 4,646,770 A * 3/1987 Lobato ..... E04H 15/003 135/124
4,665,935 A * 5/1987 Nichols ..... E04H 15/425 135/116
4,723,371 A * 2/1988 Williams ..... A01M 31/025 135/127
4,739,784 A * 4/1988 Fast ..... E04H 15/38 135/117
4,798,019 A * 1/1989 Sury ..... A01M 31/025 135/901
4,819,680 A * 4/1989 Beavers ..... E04H 15/32 135/119
4,930,534 A * 6/1990 Hill ..... E04H 15/003 135/117
5,067,505 A * 11/1991 Cantwell ..... E04H 15/54 135/125
5,345,962 A * 9/1994 Moss ..... E04H 15/18 135/116
5,352,149 A * 10/1994 Melashenko ..... A47G 5/00 160/135
5,377,711 A * 1/1995 Mueller ..... E04H 15/001 135/115
5,427,381 A * 6/1995 Macaluso ..... A63B 63/004 273/400
5,487,402 A * 1/1996 Clary ..... E04H 15/44 135/87
5,494,066 A * 2/1996 McMahan ..... A47C 29/006 135/116
5,531,258 A * 7/1996 Poulson ..... F16B 7/105 160/376
5,546,971 A * 8/1996 Leonhardt ..... E04H 15/003 135/127
5,609,176 A * 3/1997 Weeks ..... E04H 15/001 135/96
D379,487 S * 5/1997 Gale ..... E04H 15/32 D21/837
5,690,339 A * 11/1997 Chen ..... A63B 63/004 273/400
5,842,939 A * 12/1998 Pui ..... A63B 63/004 473/478
5,878,802 A * 3/1999 Richter ..... A47G 5/00 160/135
6,109,281 A * 8/2000 Lowenthal ..... E04H 15/003 135/117
6,135,894 A * 10/2000 Cho ..... A63B 71/022 273/400
6,264,570 B1 * 7/2001 Yoon ..... A63B 69/36 273/400
6,415,806 B1 * 7/2002 Gillis ..... E04H 15/425 135/124
6,453,922 B1 * 9/2002 Dufort ..... E04H 15/003 135/117
6,463,948 B2 * 10/2002 Lee ..... E04H 15/425 135/136
6,622,771 B2 * 9/2003 Plockmeyer ..... A47G 5/00 114/39.21
6,848,460 B2 * 2/2005 Zheng ..... E04H 15/324 135/126
6,857,460 B1 * 2/2005 Mowry ..... F41H 5/06 160/351
7,025,073 B2 * 4/2006 Holub ..... E04H 15/425 135/119
7,231,954 B2 * 6/2007 Green ..... E01F 13/022 135/114
7,235,025 B2 * 6/2007 Quinn ..... A63B 24/0021 273/127 R
7,600,554 B1 * 10/2009 Wright ..... E01F 7/00 160/327
7,673,642 B1 * 3/2010 Shires ..... E04H 15/36 135/136
7,836,906 B2 * 11/2010 Zheng ..... G06F 3/0221 135/91
7,866,369 B2 * 1/2011 Domolato ..... A47C 7/563 160/351
8,056,572 B2 * 11/2011 Livacich ..... A01M 31/025 135/98
8,066,022 B2 * 11/2011 Schlipf ..... E04H 15/001 135/147
8,459,327 B2 * 6/2013 Livacich ..... E04H 15/04 160/135
D717,382 S * 11/2014 Lore ..... D21/705
8,875,774 B1 * 11/2014 Flores ..... E04G 21/243 160/351
8,894,511 B2 * 11/2014 Lore ..... A63B 63/00 473/431
8,931,498 B2 * 1/2015 Nelson ..... E04H 15/36 135/117
9,302,198 B1 * 4/2016 Faver ..... A63J 11/00
9,345,357 B1 * 5/2016 Davila, Jr. ..... A47H 1/00
9,447,602 B1 * 9/2016 Arias ..... E04H 15/58
9,512,631 B2 * 12/2016 Andon ..... A63B 5/11
9,788,658 B2 * 10/2017 King-O'Connor ..... E04H 15/02
9,795,857 B2 * 10/2017 Nelson ..... A63B 61/00
9,834,953 B2 * 12/2017 Ways ..... E04H 15/425
10,066,417 B1 * 9/2018 Linyard ..... E04H 15/36
10,557,284 B2 * 2/2020 McMillen, Jr. ..... E04H 15/58
10,604,960 B1 * 3/2020 Hulsey ..... E04H 15/001
2004/0065361 A1 * 4/2004 Pratt ..... E04H 15/324 135/148
2005/0000556 A1 * 1/2005 Chang ..... E04H 15/44 135/138
2005/0121061 A1 * 6/2005 Zheng ..... E04H 15/56 135/126
2005/0269046 A1 * 12/2005 Freeman ..... E04H 15/003 160/351
2007/0023075 A1 * 2/2007 Nissenbaum ..... E04H 15/32 135/156
2010/0116306 A1 * 5/2010 Zheng ..... E04H 15/40 135/143
2010/0243649 A1 * 9/2010 Zheng ..... E04H 4/0025 220/9.2
2013/0276847 A1 * 10/2013 Vulich ..... E04H 15/405 135/125
2013/0291917 A1 * 11/2013 Hope ..... E04H 15/005 135/146
2016/0023072 A1 * 1/2016 Holland ..... A63B 63/004 473/478
2016/0374484 A1 * 12/2016 Abernathy ..... E04H 15/005 160/351
2018/0200639 A1 * 7/2018 Chiang ..... E04H 15/006
2018/0251991 A1 * 9/2018 Williams ..... E04H 1/125
2019/0352925 A1 * 11/2019 Pearson ..... E04H 15/642
2020/0131762 A1 * 4/2020 Horton ..... E04H 15/005

* cited by examiner

URBAN HIDE SCREEN FOR SURVEILLANCE OPERATIONS IN URBAN ENVIRONMENTS

FIELD OF THE INVENTION

This application relates to hide screens and, more particularly, yet not exclusively, hide screens for surveillance operations in buildings.

BACKGROUND OF THE INVENTION

There exists a need for an improved hide screen for surveillance operations in an urban environment.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Preferred Embodiment, which is to be read in association with the accompanying drawings, wherein.

SUMMARY OF THE INVENTION

Figure 1:
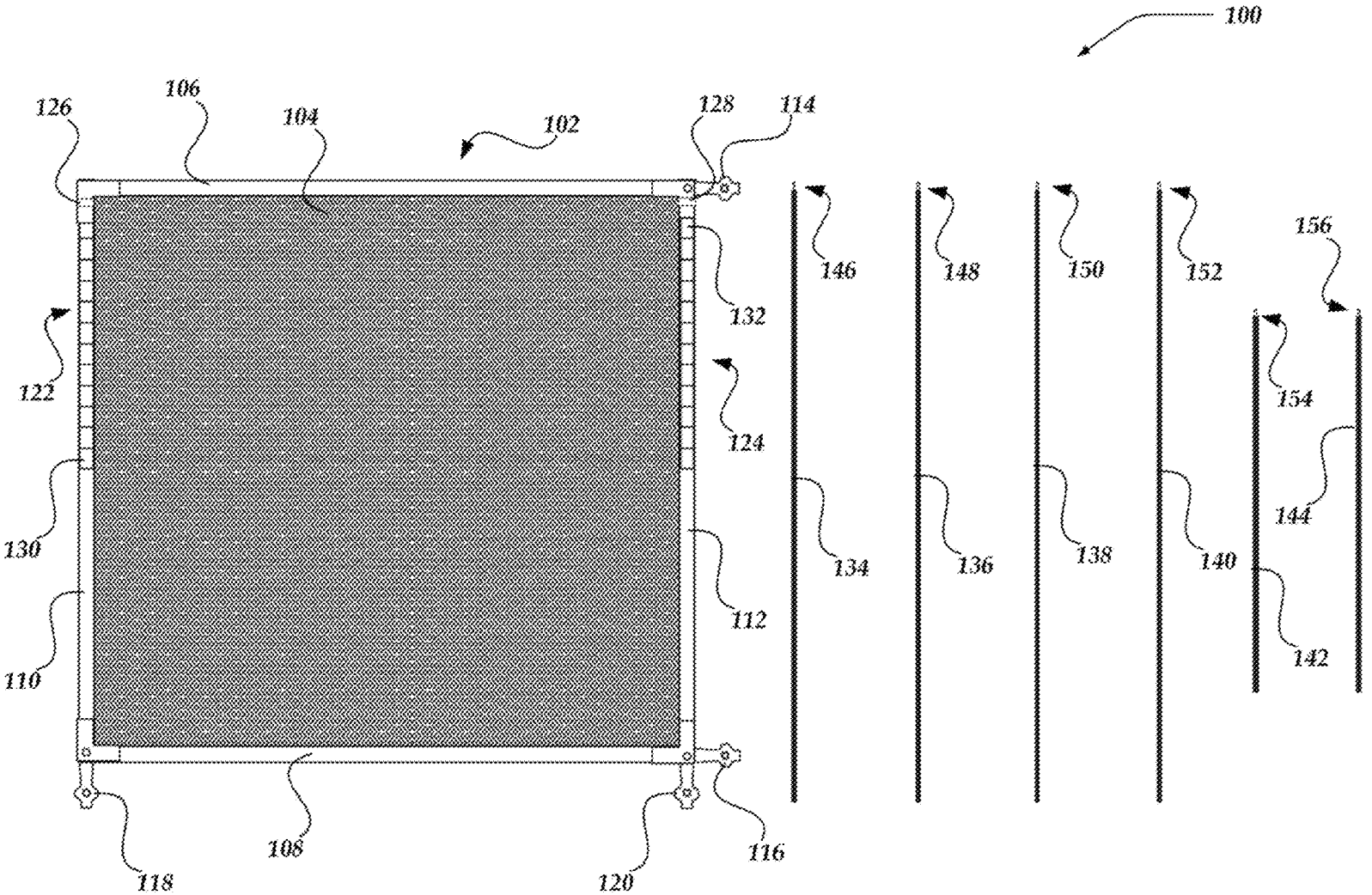
FIG. 1 is an interior-side view of a flat hide screen, with netting frame and frame poles separated from each other before installation in a building.

The following briefly describes example embodiments of the invention to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to a hide screen for surveillance operations in urban environments. The hide screen may include a netting panel, sleeves, and frame poles. One or more of the sleeves may be coupled to the netting panel. The frame poles may be insertable into the sleeves to tension the netting panel.

In some embodiments, the sleeves surround the netting panel.

In some embodiments, an adjustable anchor support may be coupled to one or more of the sleeves to removably anchor the hide screen in a building. Preferably, the adjustable anchor support includes a plurality of pockets disposed along one or more of the sleeves. In some embodiments, an anchor pole is selectively insertable into the pockets to adjust an effective height of the anchor pole.

In some embodiments, one or more of the sleeves may be curved when the frame poles are inserted into the sleeves and the netting panel is tensioned.

In some embodiments, the netting panel may be curved when the frame poles are inserted into the sleeves and the netting panel is tensioned.

In some embodiments, the netting panel may have a concave shape when the frame poles are inserted into the sleeves and the netting panel is tensioned.

In some embodiments, another netting panel may be coupled to one or more of the sleeves. Preferably, an entirety of the other netting panel may be disposed in a single plane when the frame poles are inserted into the sleeves and the netting panel and the other netting panel are tensioned.

In some embodiments, a first grommet tab may be coupled to a first sleeve in the plurality of sleeves. In one or more embodiments, the first grommet tab may have a first grommet. In some embodiments, a second grommet tab may be coupled to a second sleeve in the plurality of sleeves. In one or more embodiments, the second grommet tab may have a second grommet. In some embodiments, a frame support sleeve may be coupled to a third sleeve in the plurality of sleeves. In one or more embodiments, a frame support pole may be insertable into the frame support sleeve, the first grommet, and the second grommet to tension the netting panel.

Also, briefly stated, various embodiments are directed to a hide screen system for surveillance operations in urban environments. The hide screen system may include a first hide screen and a second hide screen. The first hide screen may include a first netting panel, first sleeves, and first frame poles. One or more of the first sleeves may be coupled to the first netting panel. The first frame poles may be insertable into the first sleeves to tension the first netting panel. The second hide screen may include a second netting panel, second sleeves, and second frame poles. One or more of the second sleeves may be coupled to the second netting panel. The second frame poles may be insertable into the second sleeves to tension the second netting panel.

In some embodiments, the second sleeves surround the second netting panel.

In some embodiments, an adjustable anchor support may be coupled to one or more of the first sleeves to removably anchor the first hide screen in a building. Preferably, the adjustable anchor support includes a plurality of pockets disposed along one or more of the first sleeves. In one or more embodiments, an anchor pole may be selectively insertable into the pockets to adjust an effective height of the anchor pole.

In some embodiments, one or more of the first sleeves may be curved when the first frame poles are inserted into the first sleeves and the first netting panel is tensioned. In one or more embodiments, each of the second sleeves are straight when the second frame poles are inserted into the second sleeves and the second netting panel is tensioned.

In some embodiments, the first netting panel may be curved when the first frame poles are inserted into the first sleeves and the first netting panel is tensioned. In one or more embodiments, an entirety of the second netting panel may be disposed in a single plane when the second frame poles are inserted into the second sleeves and the second netting panel is tensioned.

In some embodiments, the first netting panel may have a concave shape when the first frame poles are inserted into the first sleeves and the first netting panel is tensioned. In one or more embodiments, an entirety of the second netting panel may be disposed in a single plane when the second frame poles are inserted into the second sleeves and the second netting panel is tensioned.

Also, briefly stated, various embodiments are directed toward a method of using the hide screen system. The second hide screen may be removably installed at a first position in a building having a window or doorway. The first position may be spaced apart from the window or doorway and in a line of sight from the window or doorway. The first hide screen may be removably installed between the second hide screen and the window or doorway to define an observation area between the first hide screen and the second hide screen. One or more events, actions, people, or locations outside the building may be observed through the first hide screen and the window or doorway.

In some embodiments, one or more of the first sleeves may be curved based on the first frame poles being inserted into the first sleeves and the first netting panel being tensioned. In one or more embodiments, each of the second sleeves may be straight based on the second frame poles being inserted into the second sleeves and the second netting panel being tensioned.

In some embodiments, the first netting panel may be curved based on the first frame poles being inserted into the first sleeves and the first netting panel being tensioned. In one or more embodiments, an entirety of the second netting panel may be disposed in a single plane based on the second frame poles being inserted into the second sleeves and the second netting panel being tensioned.

DETAILED DESCRIPTION OF THE PREFERRED EMBODIMENTS

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

As used herein, the term "removably installed" or "removably anchor" refers to installation or anchoring that facilitates removing the installed or anchored item without damaging an object or area where the item was installed or anchored and without leaving evidence of the installation or anchoring, without the need for repairs. For example, a removably installing or anchoring a hide screen in a building refers to installing or anchoring the hide screen in a building such that the hide screen may be removed from the building without requiring repairs to the building to remove evidence of the installation or anchoring.

In addition, as used herein, the term "or" refers to a grammatical conjunction to indicate that one or more of the connected terms may be employed. For example, the phrase "one or more A, B, or C" is employed to discretely refer to each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

FIG. 1 is an interior-side view of flat hide screen 100. Flat hide screen 100 facilitates faster and simpler installation and uninstallation compared to typical hide screens, without damaging the building in which flat hide screen 100 is installed. Flat hide screen 100 includes netting frame 102 that can be folded or otherwise compressed for portability. Netting frame 102 includes netting 104 coupled to and surrounded by fabric sleeves (for example, nylon sleeves), such as top sleeve 106, bottom sleeve 108, side sleeve 110, and side sleeve 112. Netting 104 may include no-see-um or mosquito netting and may be stitched to one or more portions of the sleeves. Each of the sleeves may be closed at one end portion and may have a grommet tab at the opposite open-end portion. Top sleeve 106 has grommet tab 114, bottom sleeve 108 has grommet tab 116, side sleeve 110 has grommet tab 118, and side sleeve 112 has grommet tab 120. Each grommet tab includes a grommet (for example, a metal grommet) disposed in a fabric tab that extends from the open-end portion of the corresponding sleeve. The fabric tabs may include the same or different material than the sleeves.

Flat hide screen 100 includes one or more adjustable anchor supports, such as adjustable anchor support 122 disposed in sleeve 110 and adjustable anchor support 124 disposed in sleeve 112. Each adjustable anchor support includes a sleeve (for example, sleeve 126 or sleeve 132) disposed at one end portion of the adjustable anchor support and multiple fabric pockets (for example, pocket 130 or pocket 132) disposed along the adjustable anchor support, from the sleeve to the opposite end portion. Preferably, each adjustable anchor support is disposed on the interior side of flat hide screen 100 (opposite side of flat hide screen 100 from the window or doorway) to facilitate decreasing visibility of flat hide screen 100 from outside the building.

Flat hide screen 100 includes multiple poles that are insertable into the sleeves of flat hide screen 100. Frame poles 134-140 are insertable into sleeves 106-112 (see FIG. 2). Anchor poles 142 and 144 are insertable into sleeves 126 and 128. One or more end portions of the poles may have male end portions (for example, male end portions 146-156) that have smaller diameters than the remainder of the poles. Male end portions 146-152 of frame poles 134-140 are insertable into the grommets of grommet tabs 114-120 after frame poles 134-140 have been inserted into sleeves 106-112 (see FIG. 2).

Figure 2:
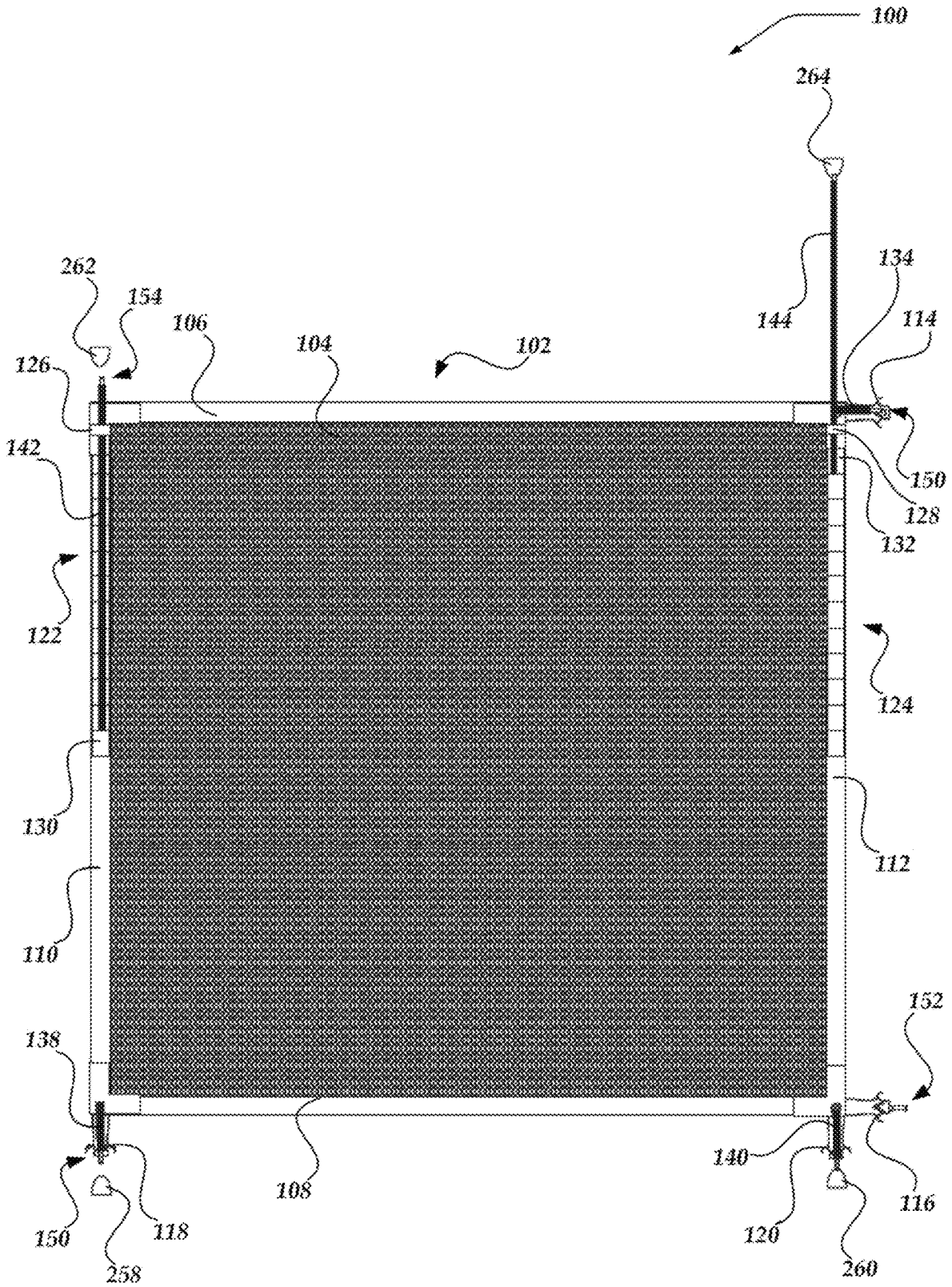
FIG. 2 is an interior-side view of the flat hide screen of FIG. 1, with the frame poles in the netting frame for installation in a building.

FIG. 2 is an interior-side view of flat hide screen FIG. 100, with the frame poles in netting frame 102 for installation in a building. The distance between the tops of support poles 142 and 144 or rubber stoppers 262 and 268 and the top edge of netting frame 102 is adjustable by selecting the fabric pockets in adjustable anchor supports 122 and 124 to receive the bottom end portions of support poles 142 and 144. Preferably, each pocket provides a height difference of 5 cm relative to the immediately above pocket or the immediately below pocket. As shown in FIG. 2, the bottom end portion of support pole 142 is disposed in pocket 130, and the bottom end portion of support pole 144 is disposed in the pocket immediately below pocket 132. Adjustable anchor supports 122 and 124 facilitate increased reliability compared to adjustable poles, such as drywall support rods.

Frame sleeves 106-112 are positioned and oriented to facilitate each of the frame support poles being transverse (for example, perpendicular) to one or more others of the frame poles to increase structural strength of flat hide screen 100. In FIG. 2, at least the bottom frame pole in sleeve 108 crosses the vertical frame pole in sleeve 112. The frame pole in sleeve 112 may also cross or at least partially cross the pole in top sleeve 106. The frame pole in sleeve 110 may cross one or more portions of one or more of the frame poles in sleeves 106 or 108.

To install each of frame poles 134-140, the frame pole is fully inserted into the corresponding one of sleeves 106-112, the user grips the frame pole with one hand and the corresponding one of grommet tabs 114-120 with the other hand, pushes the frame pole toward the closed end portion of the sleeve while pulling on the grommet tab to shorten the effective length of the frame pole by bending the frame pole, and inserts the male end portion of the frame pole into the grommet of the grommet tab. Grommet tabs 114-120 may have ladder locks or another mechanism that facilitates adjusting the length of grommet tabs 114-120. Accordingly, when using grommet tabs with adjustable lengths, the user does not need to shorten the effective length of the frame poles and can instead lengthen the grommet tabs, insert the male end portions of the frame poles into the grommets, and shorten the lengths of the grommet tabs. Male end portions 150 and 152 of frame poles 138 and 140 are insertable into rubber stoppers 258 and 260, with rubber stoppers being disposed opposite grommet tabs 118 and 120 from sleeve 108, to facilitate increasing the friction coefficient of flat hide screen 100 against the floor. Male end portions 154 and 156 of support poles 142 and 144 are insertable into rubber stoppers 262 and 264 to facilitate increasing the friction coefficient of flat hide screen 100 and the ceiling. To remove each of frame poles 134-140, the process is reversed.

The perimeter of netting frame 102 may have one or more couplers (for example, snaps, hooks, hook-and-loop fasteners, or other couplers) that facilitate removably attaching a blackout screen (not shown) to netting frame 102 to facilitate decreasing the amount of light that passes through flat hide screen 100. The blackout screen may be sized and dimensioned the same as or slightly larger than netting 104 and may have one or more corresponding couplers (for example, snaps, holes to receive hooks, hook-and-loop fasteners, or other couplers). The blackout screen may include no-see-um netting, mosquito netting, or nontransparent fabric.

Figure 3:
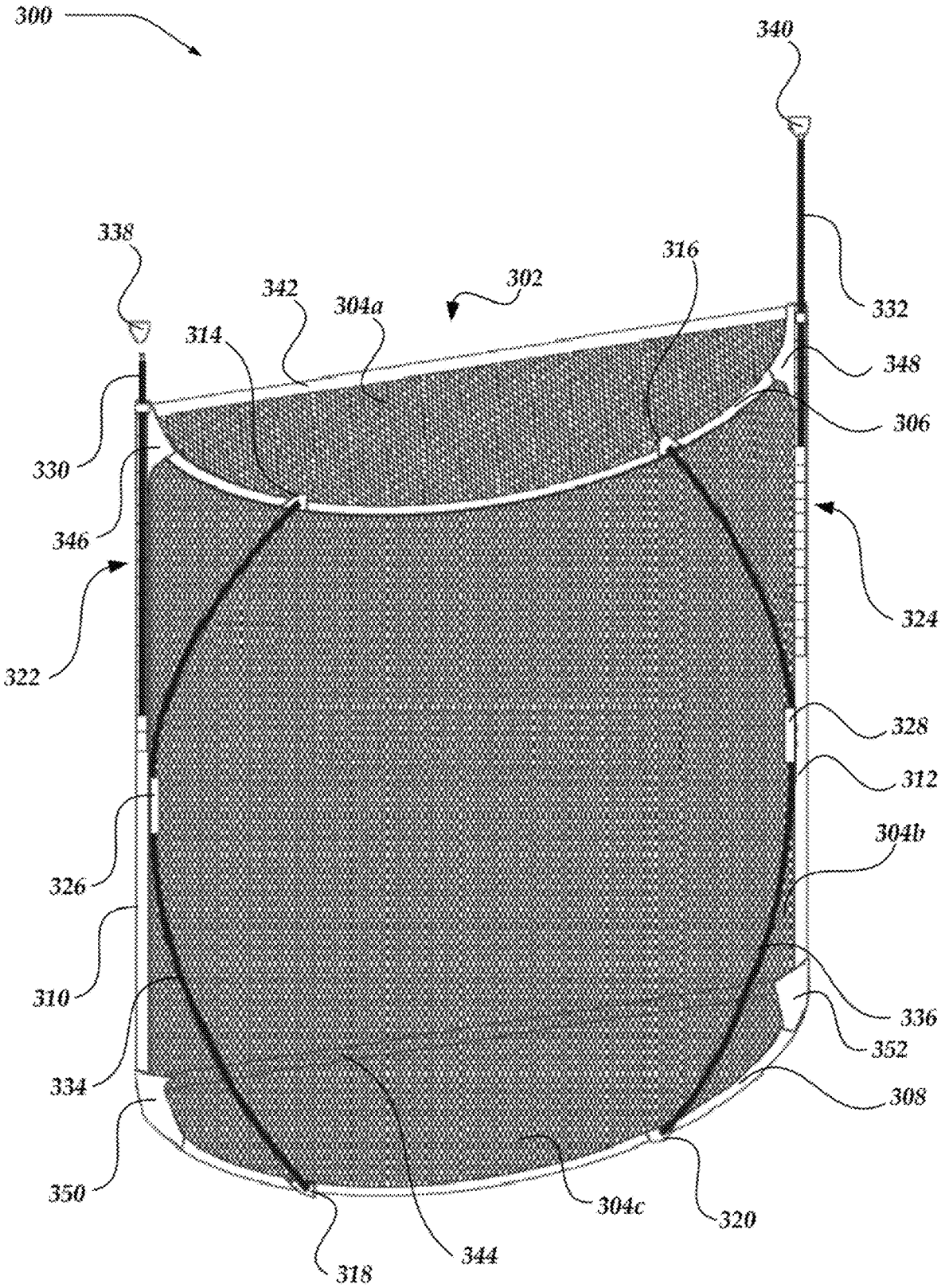
FIG. 3 is an interior-side view of a curved hide screen.
Figure 4:
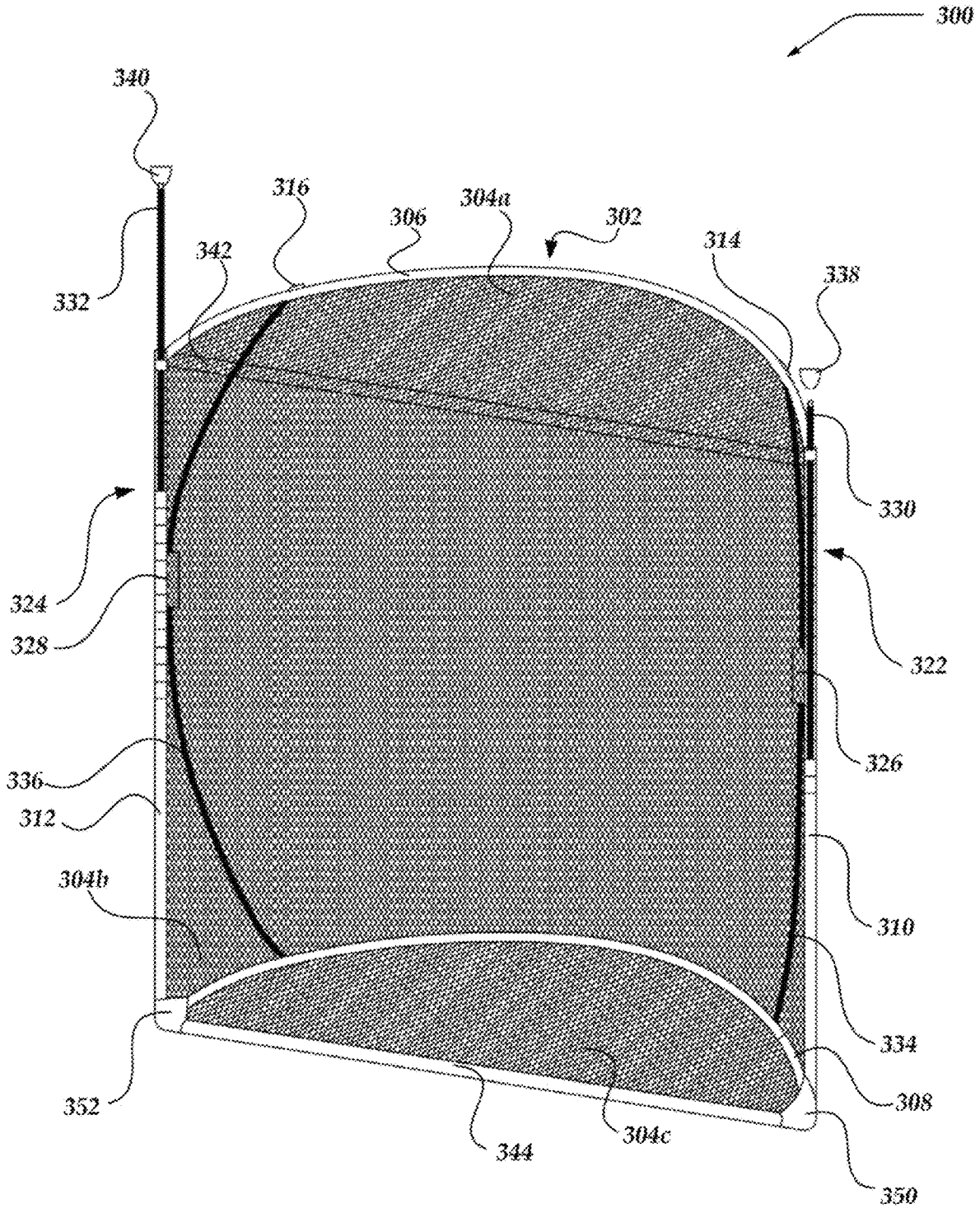
FIG. 4 is an exterior-side view of the curved hide screen of FIG. 3.

FIG. 3 is an interior-side view of curved hide screen 300. FIG. 4 is an exterior-side view of curved hide screen 300. Curved hide screen 300 facilitates faster and simpler installation and uninstallation compared to typical hide screens, without damaging the building in which curved hide screen 300 is installed. Curved hide screen 300 also has lower visibility than typical hide screens from outside the building, leaving a window or doorway where curved hide screen is installed visually appearing the same or nearly the same as other windows or doorways in the building. Curved hide screen 300 filters all or nearly all light entering a room from the window or doorway in a manner that provides an illusion of greater depth between the window and curved hide screen 300 than exists, thereby decreasing the visibility of the hide screen in comparison to typical hide screens. For increased visual protection, curved hide screen 300 may be used in combination with flat hide screen 100.

Curved hide screen 300 may be installed at a window or doorway, and flat hide screen 100 may be installed at a position that is spaced apart from curved hide screen 100 on the opposite side of curved hide screen 300 from the window or doorway, with or without the blackout screen installed. Surveillance operations (for example, surveillance, sniper observations, or others) may be conducted by operators positioned between curved hide screen 300 and flat hide screen 100, and a work area that contains electronics that emit light (for example, laptops) may be positioned opposite flat hide screen 100 from curved hide screen 300. This combination facilitates decreasing visibility of the operators' silhouettes from outside the building and decreasing visibility of light emitted by the electronics in the work area.

Curved hide screen 300 includes netting frame 302 that can be folded or otherwise compressed for portability. Netting frame 302 includes netting 304 coupled to fabric sleeves (for example, nylon sleeves), such as top sleeve 306, bottom sleeve 308, side sleeve 310, and side sleeve 312. Netting 304 may include no-see-um or mosquito netting and may be stitched to one or more portions of the sleeves. Netting 304 may include multiple netting panels, such as top netting panel 304*a*, curved netting panel 304*b*, and bottom netting panel 304*c*. The netting panels may be integral to or separate and distinct from each other. Each of the sleeves may be open at each end portion. Top sleeve 306 has grommet tabs 314 and 316, and bottom sleeve 308 has grommet tabs 318 and 320. Each grommet tab includes a grommet (for example, a metal grommet) disposed in a fabric tab that extends from the corresponding sleeve. The fabric tabs may include the same or different material than the sleeves.

Curved hide screen 300 includes one or more adjustable anchor supports, such as adjustable anchor support 322 or adjustable anchor support 324. Adjustable anchor supports 322 and 324 include similar components as explained regarding adjustable anchor supports 122 and 124, such as sleeves and multiple fabric pockets disposed along adjustable anchor supports 322 and 324, from the sleeves to the opposite end portions. Preferably, each adjustable anchor support is disposed on the interior side of curved hide screen 300 (opposite side of curved hide screen 300 from the window or doorway) to facilitate decreasing visibility of curved hide screen 300 from outside the building (see FIG. 3). Alternatively, one or more adjustable anchor supports may be disposed on the exterior side of curved hide screen 300 (see FIG. 4). Curved hide screen 300 also includes sleeves 326 and 328 coupled to sleeves 310 and 312.

Curved hide screen 300 includes multiple poles that are insertable into the sleeves of curved hide screen 300. Frame poles (for example, frame poles 542-548 in FIGS. 5 and 6) are insertable into sleeves 306-312. Anchor poles 330 and 332 are insertable into the sleeves of adjustable anchor supports 322 and 324. Frame support poles 334 and 336 are insertable into sleeves 326 and 328. One or more end portions of the poles may have male end portions that have smaller diameters than the remainder of the poles. Frame support poles 334 and 336 may have male end portions at each end portion of frame support poles 334 and 336 (see FIG. 5), with the male end portions being insertable into the grommets of grommet tabs 326 and 328 while frame support poles 334 and 336 are in sleeves 326 and 328. Anchor poles 330 and 332 may have male end portions at only one end portion (see FIG. 5) to facilitate inserting the male end portions of anchor poles 330 and 332 into rubber stoppers 338 and 340.

The exterior-side perimeter of top and bottom netting panels 304*a* and 304*c* may be attached to fabric strips 342 and 344 that extend from one end portion of top and bottom sleeves 306 and 308 to the other end portion of top and bottom sleeves 306. Preferably, fabric strips 342 and 344 include the same material as the sleeves (see FIG. 3). Alternatively, one or more of strips 342 and 344 may include the same material as netting 304 (see the top strip in FIG. 4).

Figure 6:
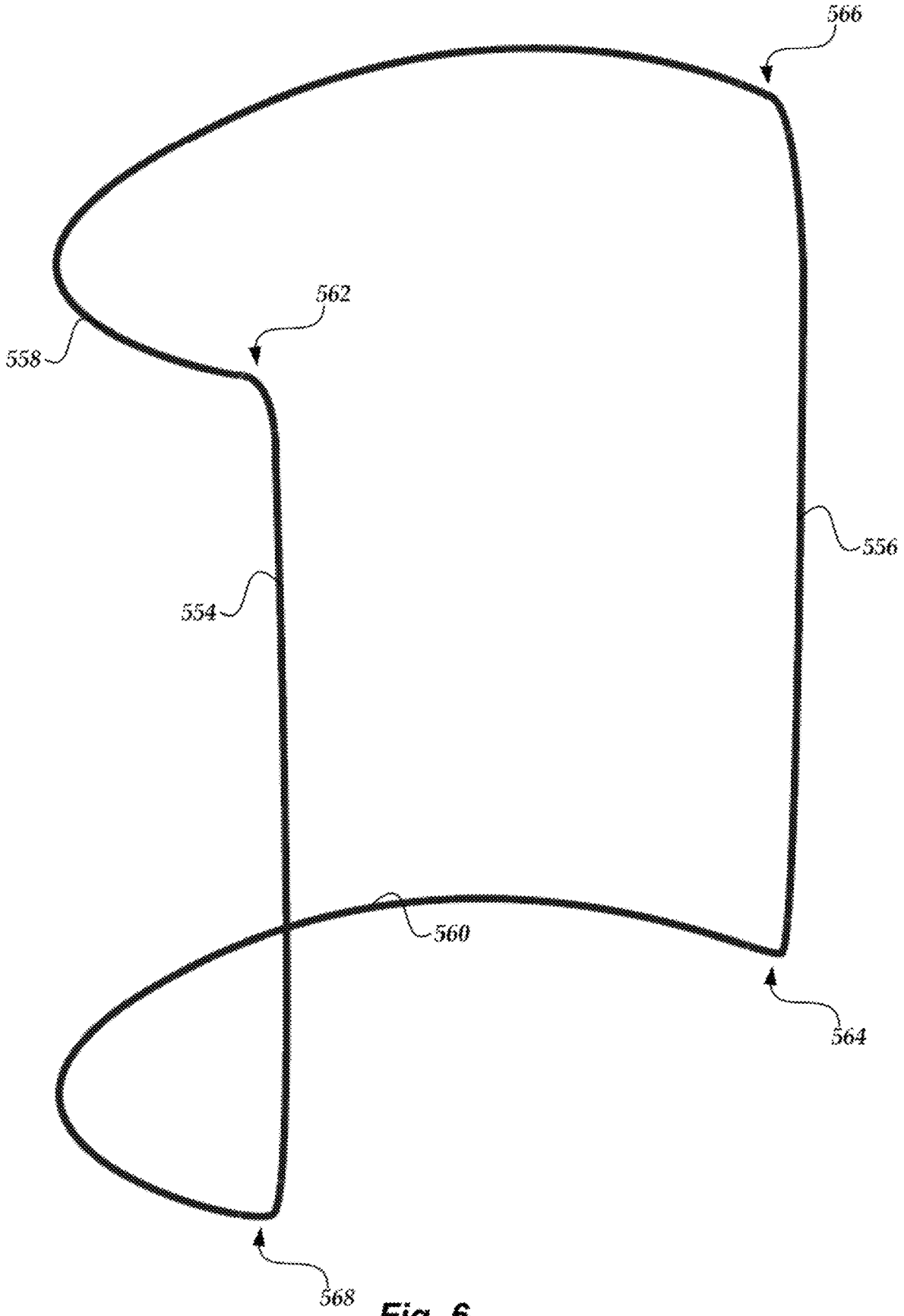
FIG. 6 is an isometric view of the frame poles of FIG. 5 assembled without the netting and sleeves to show the arrangement of the frame poles when installed in sleeves of the curved hide screen of FIG. 3.

Curved hide screen 300 may include one or more spanning members, such as spanning members 346-352, to facilitate retaining the frame poles in their intended position and orientation after installation (see FIG. 6). Preferably, the spanning members are disposed on the interior side of curved hide screen 300 (see FIG. 3). Alternatively, the spanning members may be disposed on the exterior side of curved hide screen 300 (see FIG. 4). One or more of the spanning members may removably cover one or more openings to one or more sleeves to facilitate inserting the frame poles into the frame sleeves.

Figure 5:
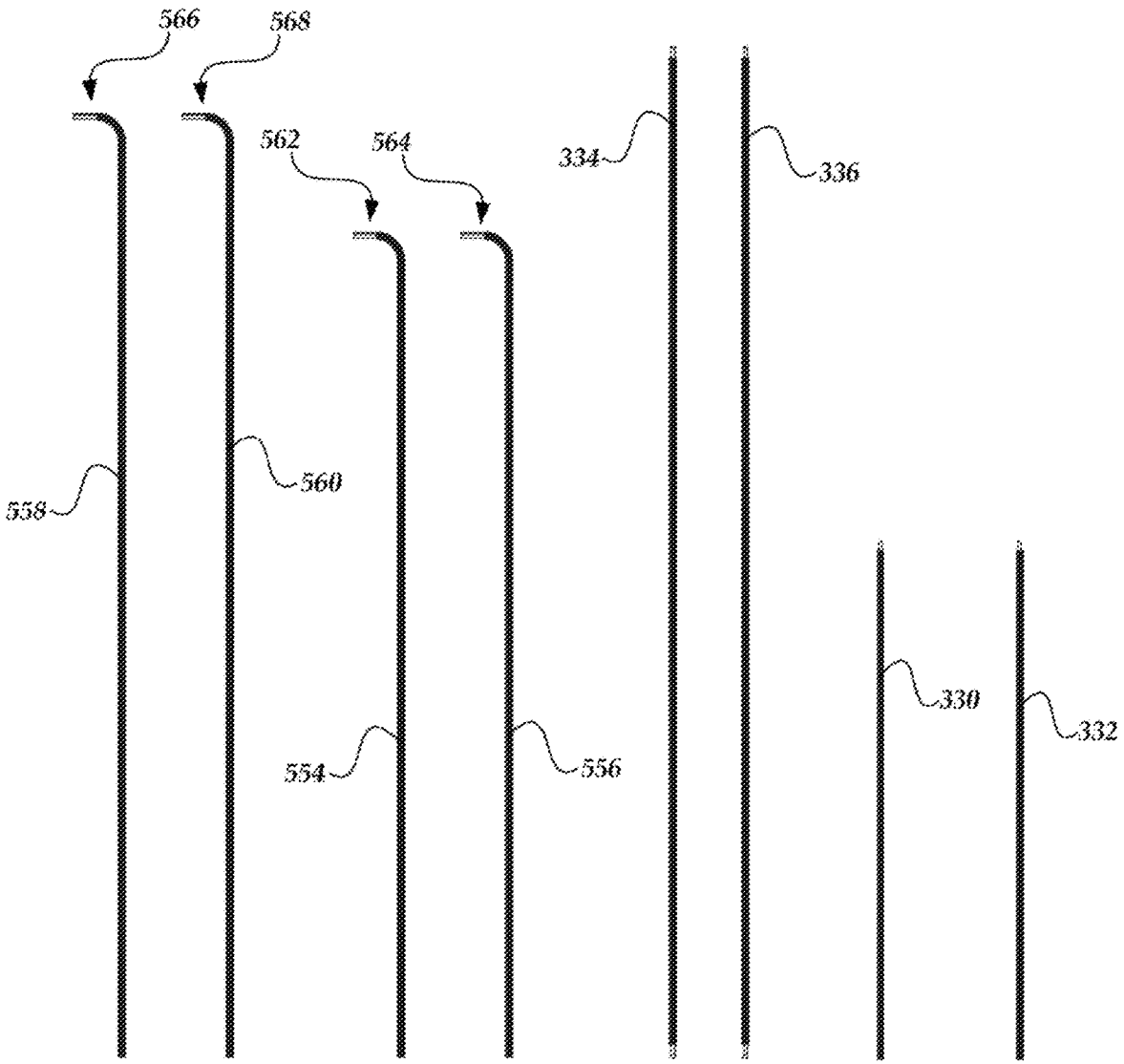
FIG. 5 shows poles of the curved hide screen of FIG. 3.

FIG. 5 shows the poles of curved hide screen of FIG. 300, including frame poles 554-560, frame support poles 334 and 336, and anchor poles 330 and 332. FIG. 6 is an isometric view of frame poles 554-560 assembled without netting frame 302 to show the arrangement of frame poles 554-560 when installed in sleeves 306-312 of curved hide screen 300. Frame poles 554-560 may have male end portions 562-568 that have smaller diameters than the remainder of the poles, and the opposite end portions of frame poles 554-560 may have female end portions that are sized and dimensioned to insertably receive the male end portions of one or more other frame poles (see FIG. 6). Frame poles 554-560 may be curved at the male end portions to facilitate providing the shape of curved hide screen 300 when connected to each other (see FIG. 6). Frame poles 554-560 may have shock cords to facilitate quick and easy installation and component management when in the field. Frame poles 554-560 may be normally straight, and top and bottom frame sleeves 306 and 308 may be curved to tensionably curve frame poles 558 and 560.

Because curved hide screen 300 has a curved perimeter along curved netting panel 304*b* and is offset back from the window or doorway, netting 304 facilitates diffusing light received into the concaved space between top and bottom netting panels 304*a* and 304*c*, rendering curved hide screen 300 less visible from outside buildings than flat netting of typical hide screens. The curved perimeter also facilitates providing coverage along the edges of the window or doorway, unlike a flat hide screen that is offset from a window or doorway.

Flat hide screen 100 and curved hide screen 300 may be provided in multiple sizes, such as slightly taller and wider than typical residential windows or doorways or slightly taller and wider than typical hotel windows or sliding double doors. Preferably, flat hide screen 100 is wider than curved hide screen 300 (for example, 8 feet wide) Flat hide screen 100 and curved hide screen 300 may each have an individual weight of less than 2 pounds. The poles of flat hide screen 100 and curved hide screen 300 may include aluminum, carbon fiber, or fiberglass. The anchor poles of flat hide screen 100 and curved hide screen 300 facilitate installing and uninstalling in buildings without leaving evidence, unlike taping or nailing typical hide screens, and also allows securing flat hide screen 100 and curved hide screen 300 in concrete buildings where nails are impractical. Where anchor poles are not practical (for example, ceiling damaged or higher than the anchor poles can reach), flat hide screen 100 or curved hide screen 300 may be zip tied to curtain rods or other structures in the building. Flat hide screen 100 and curved hide screen 300 may be installed and uninstalled in shorter periods of time than typical hide screens, thereby providing a higher likelihood that they will be employed in surveillance operations, especially where the operator must move frequently (for example, snipers).

The foregoing examples should not be construed as limiting or exhaustive, yet rather, illustrative use cases to show implementations of at least one of the various embodiments of the invention. Accordingly, many changes can be made without departing from the spirit and scope of the invention. For example, although curved hide screen 300 is shown as having a perimeter with a curvature of a portion of an ellipse, curved hide screen 300 may be box-shaped, radiused like a half cylinder, or dome-shaped to eliminate corners. As another example, although curved hide screen 300 is shown as concave, curved hide screen 300 may be convex. Also, for example, curved hide screen 300 may have multiple curves along curved netting panel 304*b*. As another example, although curved hide screen 300 is shown with flat netting panels 304*a* and 304*c* being disposed above and below curved netting panel 304*b*, curved hide screen 300 may be oriented with flat netting panels 304*a* and 304*c* being vertically oriented on left and right sides of curved netting panel 304*b*. Thus, the scope of the invention is not limited by the disclosure of the examples. Instead, the invention should be determined entirely by reference to the claims that follow.

The embodiments of the invention in which an exclusive property or privilege is claimed are defined as follows:

1. A hide screen for surveillance operations in urban environments, comprising:

a netting panel;

a plurality of sleeves, one or more of the sleeves being coupled to the netting panel;

a plurality of frame poles that are insertable into the sleeves to tension the netting panel;

an adjustable anchor support coupled to one or more of the sleeves, the adjustable anchor support comprising a plurality of pockets disposed vertically along one or more of the sleeves; and an anchor pole that is selectively insertable into any one of the plurality of pockets to adjust an effective height of the anchor pole.

2. The hide screen of claim 1, wherein one or more of the sleeves are curved when the frame poles are inserted into one or more of the sleeves and the netting panel is tensioned.

3. The hide screen of claim 1, wherein the netting panel has a concave shape when the frame poles are inserted into one or more of the sleeves and the netting panel is tensioned.

4. The hide screen of claim 1, further comprising another netting panel coupled to one or more of the sleeves.

5. The hide screen of claim 1, further comprising another netting panel coupled to one or more of the sleeves, an entirety of the other netting panel being disposed in a single plane when the frame poles are inserted into one or more of the sleeves and the netting panel and the other netting panel are tensioned.

6. The hide screen of claim 1, further comprising:

a first grommet tab coupled to a first sleeve in the plurality of sleeves, the first grommet tab having a first grommet;

a second grommet tab coupled to a second sleeve in the plurality of sleeves, the second grommet tab having a second grommet;

a frame support sleeve coupled to a third sleeve in the plurality of sleeves; and a frame support pole that is insertable into the frame support sleeve, the first grommet, and the second grommet to tension the netting panel.

7. A hide screen system for surveillance operations in urban environments, comprising:

a first hide screen, the first hide screen comprising:

a first netting panel;

a first plurality of sleeves coupled to the first netting panel and surrounding the first netting panel; and a first plurality of frame poles that are insertable into one or more of the sleeves in the first plurality of sleeves to tension the first netting panel into a smooth curved surface shape without poles interrupting the smooth surface or extending across a mid-portion of at least one face of the first netting panel; and a second hide screen, the second hide screen comprising:

a second netting panel;

a second plurality of sleeves coupled to the second netting panel;

a second plurality of frame poles that are insertable into one or more of the sleeves in the second plurality of sleeves to tension the second netting panel;

an adjustable anchor support coupled to one or more of the sleeves in the first plurality of sleeves, the adjustable anchor support comprising a plurality of pockets disposed vertically along one or more of the sleeves in the first plurality of sleeves; and an anchor pole that is selectively insertable into any one of the plurality of pockets to adjust an effective height of the anchor pole.

8. The hide screen system of claim 7, wherein one or more of the sleeves in the first plurality of sleeves are curved when the frame poles in the first plurality of frame poles are inserted into the sleeves in the first plurality of sleeves and the first netting panel is tensioned, and each of the sleeves in the second plurality of sleeves are straight when the frame poles in the second plurality of frame poles are inserted into the sleeves in the second plurality of sleeves and the second netting panel is tensioned.

9. The hide screen system of claim 7, wherein the first netting panel is curved when the frame poles in the first plurality of frame poles are inserted into the sleeves in the first plurality of sleeves and the first netting panel is tensioned, and an entirety of the second netting panel is disposed in a single plane when the frame poles in the second plurality of frame poles are inserted into the sleeves in the second plurality of sleeves and the second netting panel is tensioned.

10. The hide screen system of claim 7, wherein the first netting panel has a concave shape when the frame poles in the first plurality of frame poles are inserted into the sleeves in the first plurality of sleeves and the first netting panel is tensioned, and an entirety of the second netting panel is disposed in a single plane when the frame poles in the second plurality of frame poles are inserted into the sleeves in the second plurality of sleeves and the second netting panel is tensioned.

11. A method of using a hide screen system comprising:

a first hide screen, the first hide screen comprising:

a first netting panel;

a first plurality of sleeves coupled to the first netting panel and surrounding the first netting panel; and a first plurality of frame poles that are insertable into one or more of the sleeves in the first plurality of sleeves to tension the first netting panel into a smooth curved surface shape without poles interrupting the smooth surface or extending across a mid-portion of at least one face of the first netting panel; and a second hide screen, the second hide screen comprising:

a second netting panel;

a second plurality of sleeves coupled to the second netting panel; and a second plurality of frame poles that are insertable into one or more of the sleeves in the second plurality of sleeves to tension the second netting panel, the method further comprising:

removably installing the second hide screen at a first position in a building having a window or doorway, the first position being spaced apart from the window or doorway and in a line of sight from the window or doorway;

removably installing the first hide screen between the second hide screen and the window or doorway to define an observation area between the first hide screen and the second hide screen; and observing one or more events, actions, people, or locations outside the building through the first hide screen and the window or doorway.

12. The method of claim 11, wherein one or more of the sleeves in the first plurality of sleeves are curved when the frame poles in the first plurality of frame poles are inserted into the sleeves in the first plurality of sleeves and the first netting panel is tensioned, and each of the sleeves in the second plurality of sleeves are straight when the frame poles in the second plurality of frame poles are inserted into the sleeves in the second plurality of sleeves and the second netting panel is tensioned.

13. The method of claim 11, wherein the first netting panel is curved when the frame poles in the first plurality of frame poles are inserted into the sleeves in the first plurality of sleeves and the first netting panel is tensioned, and an entirety of the second netting panel is disposed in a single plane when the frame poles in the second plurality of frame poles are inserted into the sleeves in the second plurality of sleeves and the second netting panel is tensioned.

* * * * *